US005111597A

United States Patent [19]

Hansen et al.

[11] Patent Number: 5,111,597

[45] Date of Patent: May 12, 1992

[54] DANCE SHOE WITH TOE SUPPORT

[76] Inventors: Mindy L. Hansen; Mandy L. Hansen, both of 11601 Blue Sage Rd., Oklahoma City, Okla. 73120

[21] Appl. No.: 352,845

[22] Filed: May 16, 1989

[51] Int. Cl.[5] ..... A43B 5/12

[52] U.S. Cl. ..... 36/8.3; 36/77 R; 36/113

[58] Field of Search ..... 36/8.3, 77 R, 113

[56] References Cited

U.S. PATENT DOCUMENTS

| | | | |
|---|---|---|---|
| D. 282,022 | 1/1986 | Write | 36/8.3 X |
| 300,205 | 6/1884 | Brown | 36/77 R |
| 1,553,196 | 9/1925 | Solomanoff | 36/8.3 |
| 1,564,607 | 12/1925 | Meier | 36/8.3 |
| 1,729,254 | 9/1929 | Habicht | 36/77 R |
| 1,744,122 | 1/1930 | Keeling | 36/8.3 |
| 1,819,766 | 8/1931 | Capezio | 36/8.3 |
| 1,836,624 | 12/1931 | Sothen | 36/8.3 |
| 1,889,275 | 11/1932 | Domahoski | 36/8.3 |
| 1,927,211 | 9/1933 | Harris | 36/8.3 |
| 2,110,890 | 3/1938 | Paul | 36/8.3 |
| 2,151,554 | 3/1939 | Josephson . | |
| 2,160,590 | 5/1939 | Guhman . | |
| 2,292,297 | 8/1942 | Sherlock | 36/77 R |
| 2,354,338 | 7/1944 | Stritter | 36/77 R |
| 2,810,214 | 10/1957 | Wolfe | 36/8.3 |
| 3,406,469 | 10/1968 | Dani . | |
| 4,199,878 | 4/1980 | Wössner | 36/113 |
| 4,412,393 | 11/1983 | Terlizzi, Jr. et al. | 36/113 |
| 4,495,715 | 1/1985 | Fredrickson et al. . | |
| 4,519,148 | 5/1985 | Sisco | 36/91 |
| 4,541,186 | 9/1985 | Mulvihill | 36/114 |
| 4,583,304 | 4/1986 | Spalding | 36/8.3 X |

FOREIGN PATENT DOCUMENTS

| | | | |
|---|---|---|---|
| 30125 | 11/1930 | Australia | 36/8.3 |
| 425999 | 6/1911 | France | 36/8.3 |
| 2156652 | 10/1985 | United Kingdom | 36/8.3 |

OTHER PUBLICATIONS

Exhibit M—Ballet Slipper.
Exhibit A—Toe Shoe.
Exhibit B—Box and Shank.
Exhibit C—Jazz Shoe.
Exhibit D—Severed Shank.
Exhibit E—Prototype of Present Invention.
Pp. 220-222 from a book entitled "Dancing".

*Primary Examiner*—Paul T. Sewell
*Assistant Examiner*—Thomas P. Hilliard
*Attorney, Agent, or Firm*—Dunlap, Codding & Lee

[57] ABSTRACT

A dance shoe having a toe end and a heel end. The dance shoe has an outer sole which is constructed of a flexible material and an outer covering which is constructed of a flexible material connected to the outer sole with the outer covering cooperating with the outer sole to substantially encompass a foot space with a foot opening being formed through a portion of the outer covering. The foot opening and the foot space each are sized and adapted so that an individual may dispose his foot through the foot opening and into the foot space with the outer covering substantially covering the upper portion of an individual's foot when the individual's foot is disposed in the foot space. A relatively rigid toe support is disposed in the foot space generally near the toe end of the dance shoe. The toe support substantially encompasses and defines a toe space with a toe opening being formed through one end of a toe support. The toe space and the toe opening are sized and adapted so that, when an individual's foot is disposed in the foot space, the individual's toes are disposed through the toe opening and into the toe space. The toe support cooperates to enable the individual to stand on the ends of the individual's toes while wearing the dance shoes.

5 Claims, 2 Drawing Sheets

DANCE SHOE WITH TOE SUPPORT

FIELD OF THE INVENTION

The present invention generally defines a dance shoe having an outer sole constructed of a flexible material and an outer covering connected to the outer sole and substantially encompassing a foot space with a foot opening being formed through the outer covering, and a relatively rigid toe support disposed in the foot space generally near a toe end of the dance shoe, the toe support being adapted to receive and accommodate the individual's toes and to cooperate in supporting the individual while standing on the ends of the individual's toes.

DESCRIPTION OF THE PREFERRED EMBODIMENTS

Ballet is a very rigid, stylized dance form. The ballerinas wear a toe shoe which includes a covering fitting about a portion of the ballerina's foot generally adjacent the bottom of the ballerina's foot and a portion of the covering covers the ballerina's toes. A semi-rigid box (toe support) is disposed in a toe end of the toe shoe and the box is shaped and adapted to be fitted about the ballerina's toes. A rigid shank extends from the toe end of the toe shoe to the heel end of the toe shoe. The box is adapted to cooperate in supporting the ballerina on the ends of her toes and the shank cooperates to provide additional support so the ballerina can maintain here position standing on the ends of her toes. This type of toe shoe is worn by female and male ballet dancers do not wear this type of shoe.

Jazz dancing is a more flexible, free form of dancing, as compared to ballet. The jazz dance shoe comprises a flexible sole which generally is constructed of leather or rubber. A heel generally is connected to the sole and disposed near a heel end of the jazz dance shoe. The covering of the jazz dance shoe is constructed of a flexible material and the covering is shaped and adapted to fit over a substantial portion of the upper portion of the individual's foot. The covering generally is split and laces are provided to connect the split portions and secure the covering snugly to the individual's foot, although some jazz dance shoes may be in a boot form with connections along the boot sides, for example. This type of jazz dance shoe is worn by males and females.

Figure 1:
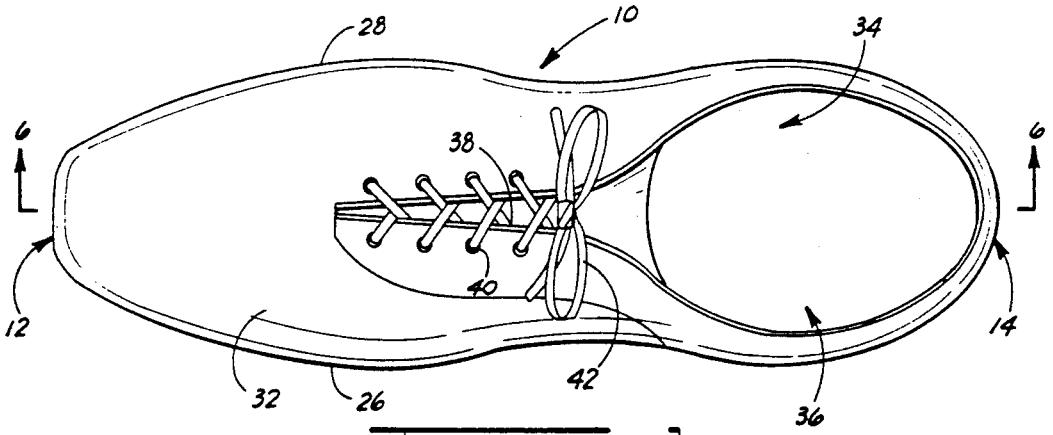
FIG. 1 is a top elevational view of a dance shoe constructed in accordance with the present invention.
Figure 2:
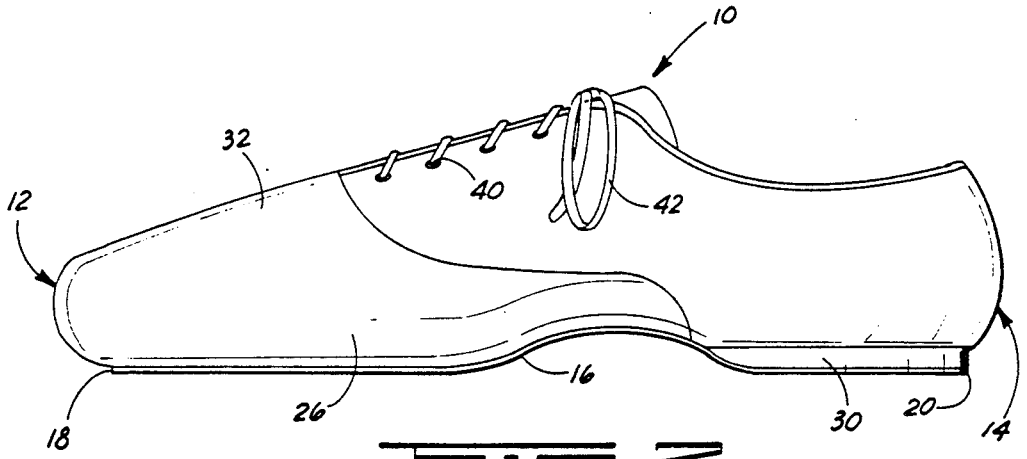
FIG. 2 is a top elevational view of the dance shoe of FIG. 1.
Figure 3:
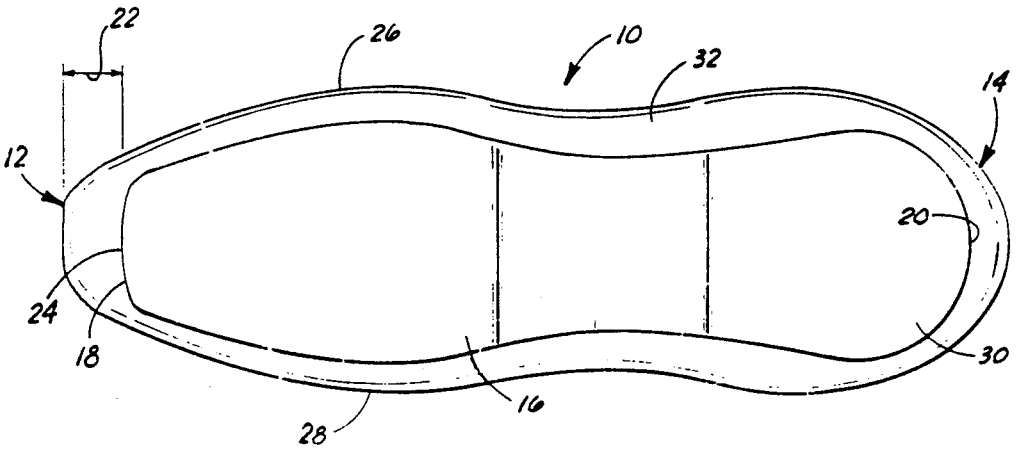
FIG. 3 is a bottom elevational view of the dance shoe of FIGS. 1 and 2.

The present invention defines an improved jazz dance shoe. Shown in FIGS. 1, 2 and 3 is a dance shoe which is constructed in accordance with the present invention and designated therein by the general reference numeral 10. Although only one dance shoe 10 is shown in the drawings, it will be understood that the dance shoe 10 of the present invention contemplates a pair of dance shoes 10 with each dance shoe being constructed exactly like the dance shoe 10, except one is shaped and adapted to fit the individual's right foot and the other is shaped and adapted to fit the individual's left foot.

The dance shoe 10 has a toe end 12 generally defining the end portion of the dance shoe 10 which is fitted about the end of the individual's toes, and a heel end 14 generally defining the end portion of the dance shoe 10 which is fitted about the individual's heel.

The dance shoe 10 includes an outer sole 16 which is constructed of a relatively flexible material such as a rubber or leather, for example. The outer sole 16 extends generally from the heel end 14 to the toe end 12 of the dance shoe 10. The outer sole 16 is shaped and adapted to extend generally over the lower portion or sole of the individual's foot when the dance shoe 10 is fitted onto the individual's foot.

The outer sole 16 has a toe end 18 and a heel end 20 with the toe end 18 of the outer sole 16 being disposed generally near, but spaced a distance 22 (FIG. 3) from the toe end 12 of the dance shoe 10, for reasons which will be made more apparent below. The toe end 18 of the outer sole 16 is formed to be a substantially flat straight line surface 24 (FIG. 3) extending generally between a left side 26 and a right side 28 of the dance shoe 10. The heel end 20 of the outer sole 16 is disposed generally adjacent the heel end 14 of the dance shoe 10.

A generally square or rectangularly shaped heel 30 is connected to the outer side 16 and disposed generally near the heel end 14 of the dance shoe 10 and generally near the heel end 20 of the outer sole 16. The heel 30 is relatively thin. The heel 30 extends a distance generally from the heel end 20 of the outer sole 16 generally toward the toe end 18 of the outer sole 16. The heel 30 is constructed of a relatively flexible material such as rubber or leather.

The dance shoe 10 includes an outer covering 32 which is constructed of a flexible material such as leather. The outer covering 32 is connected to the outer side 16 generally at the outer periphery thereof and generally about the entire outer periphery of the outer sole 16.

Figure 6:
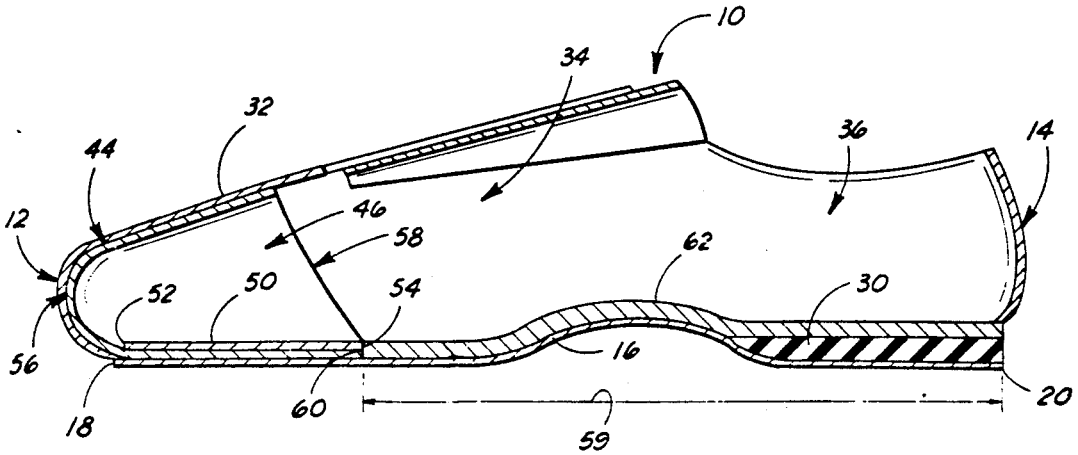
FIG. 6 is a sectional view of the dance shoe of FIGS. 1, 2 and 3, taken substantially along the lines 6—6 of FIG. 1.

The outer covering 32 extends upwardly from and generally over a substantial portion of the outer sole 16, and cooperates with the outer sole 16 to encompass a foot space 34 (FIGS. 1 and 6). The foot space 34 includes a foot opening 36 (FIGS. 1 and 6) formed through the outer covering 32 and intersecting a portion of the foot space 34. The foot opening 36 is sized and shaped so an individual's foot is disposable through the foot opening 36 and into the foot space 34. When the individual's foot is disposed in the foot space 34, the outer covering 32 covers a substantial portion of the upper portion of an individual's foot.

A slit 38 (FIG. 1) is formed in the outer covering 32. The slit 38 intersects the foot opening 36 and extends a distance generally toward the toe end 12 of the dance shoe 10. A plurality of lace openings 40 (FIGS. 1 and 2) are formed in the outer covering 32 generally along each side of the slit 38 (only one of the lace openings 40 is designated by a reference numeral in FIGS. 1 and 2). A lace 42 (FIGS. 1 and 2) is laced through the lace openings 40 and tied to cooperate to secure the outer covering 36 and the outer sole 16 to the individual's foot.

Figure 4:
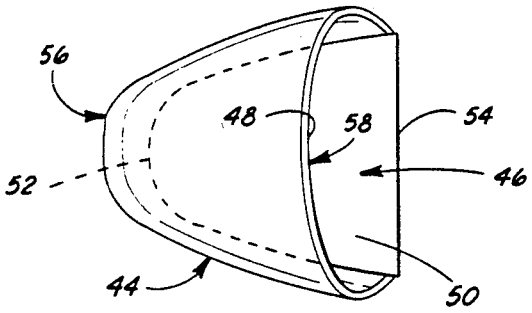
FIG. 4 is a top elevational view of a toe support portion of the dance shoe of the present invention.
Figure 5:
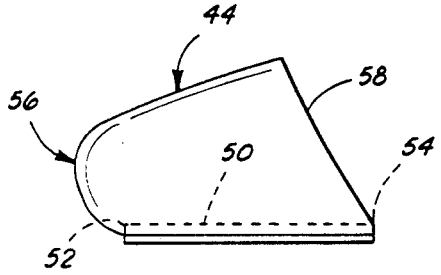
FIG. 5 is a side elevational view of the toe support of FIG. 4.

The dance shoe 10 includes a toe support 44 (FIGS. 4, 5 and 6) which is constructed of a relatively rigid material and which encompasses a toe space 46 (FIGS. 4 and 6). A toe opening 48 (FIG. 4) is formed in one end of the toe support 4. The toe opening 48 intersects the toe space 46.

The toe support 44 is disposed in the foot space 34 generally near the toe end 12 of the dance shoe 10. The toe space 46 is in communication with the foot space 34 and cooperates to form a portion of the foot space 34. The outer covering 32 extends over the sides and upper portion of the toe support 44, and cooperates with the outer sole 16 to encompass and cover the toe support 44.

The toe opening 48 is shaped and adapted to receive the individual's toes when the individual's foot is disposed in the foot space 34. The toe space 46 is sized and shaped to receive and accommodate the individual's toes whereby the toe support 44 encompasses a substantial portion of the individual's toes when the individual's foot is disposed in the foot space 34.

In one embodiment, the toe support 44 is constructed and operates substantially like the box in a toe shoe. A rearward end 58 of the toe support 44 is spaced a distance 59 from the heel end 14 of the dance shoe 10 and the distance 59 is greater than one-half of the length extending generally between the toe end 12 and the heel end 14 of the dance shoe 10 whereby the toe support 44 occupies only a relatively small portion of the foot space 34 and is disposed and confined generally to the toe end 12 portion of the dance shoe 10.

A short shank 50 (FIGS. 4, 5 and 6) which is constructed of a relatively rigid material is disposed in the toe space 46. The short shank 50 has a forward end 52 and a rearward end 54.

The forward end 52 of the short shank 50 is disposed near a closed forward end 56 of the toe support 44. The rearward end 54 of the short shank 50 is disposed generally near a rearward end 58 of the toe support 44. The short shank 50 is disposed generally adjacent the outer sole 16.

The short shank 50 cooperates with the toe support 44 to provide a support enabling the individual to stand on the end of his or her toes.

The forward end 56 of the toe support 44 and the toe end 12 of the dance shoe 10 extend the distance 22 beyond the toe end 18 of the outer sole 16 in a preformed embodiment. If the outer sole 16 is extended so the toe end 18 of the outer sole 16 is generally adjacent the toe end 12 of the dance shoe 10, the portion of the outer sole 16 generally near the toe end 18 will tend to be formed or extended over the forward end 56 of the toe support 44 after some use of the dance shoe 10.

In one preferred form, as shown more clearly in FIG. 6, a recess 60 is formed in the outer sole 16, the recess 60 being disposed generally within a portion of the foot space 34. One end of the recess 60 is spaced a distance from the toe end 18 of the outer sole 16 and the recess 60 extends to the toe end 18 of the outer sole 16. The recess 60 is sized and adapted to receive the toe support 44 so that the upper surface of the short shank 50 is disposed in a plane generally coplanar with the plane of the inner surface of an inner sole 62. In one embodiment which may be preferred in some applications, a separate inner liner can be disposed over the inner peripheral surface of the outer sole 16 and over the inner peripheral surface in the toe space 46 to eliminate the effect of any space between the toe support 44 and the inner peripheral surface of the inner sole 62.

The dance shoe 10 is designed to have a jazz shoe overall appearance so that it can be worn by males and females. Further, the dance shoe 10 retains all of the flexibility of a jazz shoe so the individual is free to perform the various maneuvers characteristic of jazz dance. In addition, the dance shoe 10 is constructed and adapted to enable the individual to stand on the ends of the individual's toes thereby enabling the individual to extend the range of styles and types of movements which may be performed by the individual while wearing the dance shoes 10 substantially beyond current styles and types of movements which are capable while wearing a typical jazz shoe.

Changes may be made in the construction and operation of the various parts and elements of the dance shoe described herein without departing from the spirit and scope of the invention as defined in the following claims.

What is claimed is:

1. An improved jazz dance shoe of the type having a toe end and a heel end with an outer sole constructed of a flexible material and without a rigid shank extending between the toe end and the heel end, and an outer covering constructed of a flexible material connected to the outer sole and cooperating with the outer sole to substantially encompass a foot space with a foot opening being formed through the outer covering whereby an individual's foot is disposable through the foot opening and into the foot space with the outer covering substantially covering an upper portion of the individual's foot and extending over a substantial portion of the individual's arch, and means for securing the outer covering to the individual's foot whereby the outer sole and the outer covering are secured snugly to the individual's foot and cooperate to cover the individual's foot, the jazz dance shoe being worn by the individual and suitable for use when the individual performing jazz dance movements, the improvement comprising:

a rigid toe support having an forward end and a rearward end and encompassing a toe space with a toe opening formed through the rearward end thereof intersecting the toe space, the toe support being disposed in the foot opening near the toe end of the jazz dance show with the forward end of the toe support being disposed near the toe end of the jazz dance shoe, whereby an individual's toes are disposable through the toe opening and disposed within the toe space when the individual's foot is disposed in the foot space, the toe support being constructed and adapted to provide a support for cooperating to enable an individual to stand on the ends of an individual's toe when the individual's foot is supported within the foot space in the jazz dance shoe, the jazz dance shoe being without a rigid shank extending between the toe end and the heel end of the jazz dance shoe, and the rearward end of the toe support being spaced a distance from the heel end of the jazz dance shoe greater than one-half of the length of the jazz dance shoe extending generally between the toe end and the heel end of the jazz dance shoe, and the jazz dance shoe with the toe support being suitable for use by the individual when performing jazz dance movements.

2. The jazz dance shoe of claim 1 wherein the jazz dance shoe includes a heel connected to the outer sole and disposed near the heel end of the shoe, the heel being constructed of a flexible material.

3. The jazz dance shoe of claim 1 wherein the means for securing the outer covering to the individual's foot further comprising a slit formed through a portion of the outer covering and intersecting a portion of the foot opening; a plurality of lace openings formed in the outer covering near the slit; and a lace laced through the laced openings, the lace being tieable to cooperate in securing the outer covering to the individual's foot.

4. The jazz dance shoe of claim 1 wherein the improvement further comprising:

a short shank having a forward end and a rearward end and being constructed of a rigid material, the short shank being secured in the tow space in the toe support with the forward end of the short shank being disposed near the forward end of the toe support and the rearward end of the short shank being disposed near the rearward end of the toe support.

5. The jazz dance shoe of claim 1 wherein the outer sole has a toe end and a heel end, the heel end of the outer sole being disposed near the heel end of the jazz dance shoe and the toe end of the outer sole being spaced a distance from the toe end of the jazz dance shoe, whereby a portion of the toe support near the forward end thereof extends a distance beyond the toe end of the outer sole.

* * * * *

UNITED STATES PATENT AND TRADEMARK OFFICE

CERTIFICATE OF CORRECTION

PATENT NO. : 5,111,597

DATED : May 12, 1992

INVENTOR(S) : Hansen, et al.

It is certified that error appears in the above-identified patent and that said Letters Patent is hereby corrected as shown below:

Column 1, line 45, delte the word "here" and substitute therefore the word --her--.

Column 3, line 5, delete the numeral "4" and substitute therefore the numeral --44--.

Column 4, line 46, delete the word "show" and substitute therefore the word --shoe--.

Column 5, line 15, delete the word "tow" and substitute therefore the word --toe--.

Signed and Sealed this

Nineteenth Day of October, 1993

Bruce Lehman

*Attest:*

BRUCE LEHMAN

*Attesting Officer*

*Commissioner of Patents and Trademarks*